US011395953B2

(12) United States Patent
Kounellas et al.

(10) Patent No.: US 11,395,953 B2
(45) Date of Patent: Jul. 26, 2022

(54) ENHANCED INFRARED HOCKEY PUCK AND GOAL DETECTION SYSTEM

(71) Applicant: Glo-Flite LLC, Seattle, WA (US)

(72) Inventors: Jamilla Kounellas, Seattle, WA (US); Kevin Hay, Des Moines, WA (US); Paul Wierenga, Seattle, WA (US)

(73) Assignee: Glo-Flite LLC, Seattle, WA (US)

( * ) Notice: Subject to any disclaimer, the term of this patent is extended or adjusted under 35 U.S.C. 154(b) by 68 days.

(21) Appl. No.: 16/886,699

(22) Filed: May 28, 2020

(65) Prior Publication Data

US 2021/0370151 A1 Dec. 2, 2021

(51) Int. Cl.
*A63B 71/06* (2006.01)
*A63B 63/00* (2006.01)
(Continued)

(52) U.S. Cl.
CPC ..... *A63B 71/0605* (2013.01); *A63B 63/004* (2013.01); *A63B 67/14* (2013.01);
(Continued)

(58) Field of Classification Search
CPC ... A63B 63/004; A63B 67/14; A63B 69/0026; A63B 71/0605; A63B 2024/004;
(Continued)

(56) References Cited

U.S. PATENT DOCUMENTS 3,727,069 A * 4/1973 Crittenden, Jr. ..... G01P 3/685 250/222.1
3,782,730 A 1/1974 Horchler
(Continued)

FOREIGN PATENT DOCUMENTS

| | | |
|---|---|---|
| EP | 1489572 A1 | 12/2004 |
| EP | 2085123 | 8/2009 |
| WO | 2007097752 | 8/2007 |

OTHER PUBLICATIONS

Wikipedia, "Photoelectric sensor", en.wikipedia.org/wiki/Photoelectric_sensor, archived Dec. 5, 2019 (Year: 2019).*

*Primary Examiner* — Laura Davison
(74) *Attorney, Agent, or Firm* — Lowe Graham Jones LLC; Ellen M. Bierman

(57) ABSTRACT

Methods, systems, and techniques for automatically detecting and tracking hockey goal events during hockey play are provided. Example embodiments provide an Automated Hockey Goal Detection System or goal detection system, which enables goal events during hockey play to be automatically and immediately detected and notifications generated therefor and for automatically tracking and communicating attributes of such events such as puck speed and location. Automated event information may be automatically recorded and/or communicated to other devices, such as a remote computing device, to analyze player or game effectiveness. An example goal detection system utilizes an infrared transmitting hockey puck and an infrared sensing goal frame with one or more sets of multiple infrared sensors arranged around the perimeter of the goal frame. The goal frame may include a control unit that determines the location and speed of the puck within the goal frame by evaluation of the active sensors.

18 Claims, 8 Drawing Sheets

(51) Int. Cl.
*A63B 67/14* (2006.01)
*A63B 69/00* (2006.01)

(52) U.S. Cl.
CPC ..... *A63B 69/0026* (2013.01); *A63B 2220/803* (2013.01); *A63B 2220/805* (2013.01); *A63B 2220/833* (2013.01); *A63B 2225/50* (2013.01); *A63B 2225/74* (2020.08)

(58) Field of Classification Search
CPC ..... A63B 2069/0008; A63B 2220/803; A63B 2220/805; A63B 2220/833; F41J 5/02; F41J 5/08
See application file for complete search history.

(56) References Cited

U.S. PATENT DOCUMENTS 3,872,455 A 3/1975 Fuller et al.
4,150,824 A * 4/1979 Villa ..... F41J 5/02 398/189
4,375,289 A 3/1983 Schmall et al.
4,763,903 A * 8/1988 Goodwin ..... F41J 5/02 250/222.1
4,949,972 A * 8/1990 Goodwin ..... F41J 5/02 250/553
4,968,036 A 11/1990 Nark
5,564,698 A * 10/1996 Honey ..... A63B 24/0021 348/E5.051
5,602,638 A * 2/1997 Boulware ..... A63B 24/0021 356/28
5,615,880 A * 4/1997 Booth ..... A63B 24/0021 273/371
5,748,073 A 5/1998 Crawford
5,816,947 A 10/1998 Kavitch
5,846,139 A * 12/1998 Bair ..... A63B 24/0021 473/156
5,926,780 A * 7/1999 Fox ..... A63B 69/3658 702/142
5,947,846 A 9/1999 Craig
6,126,561 A 10/2000 Nark
6,252,632 B1 6/2001 Cavallaro
6,972,787 B1 12/2005 Allen et al.
7,483,049 B2 1/2009 Aman et al.
7,867,113 B2 1/2011 Petersen
7,900,921 B1 3/2011 Palmer et al.
8,535,183 B2 9/2013 Eskildsen
10,016,669 B2 * 7/2018 Mason ..... A63B 71/06
10,434,397 B2 10/2019 Kounellas
10,507,374 B2 12/2019 Kounellas
11,000,750 B2 * 5/2021 Kounellas ..... A63B 67/14
2003/0210555 A1 11/2003 Cicero et al.
2005/0083201 A1 4/2005 Trosper
2005/0255787 A1 11/2005 Pak
2006/0267737 A1 11/2006 Colby
2007/0275801 A1 11/2007 Proulx et al.
2010/0222163 A1 9/2010 Eskildsen
2014/0366650 A1 12/2014 Thillainadarajah et al.
2015/0011339 A1 1/2015 Kounellas
2016/0271447 A1 9/2016 Cucco
2018/0071604 A1 * 3/2018 Tyndall ..... A63B 71/0622
2018/0104563 A1 4/2018 Kounellas
2020/0282286 A1 9/2020 Kounellas et al.

* cited by examiner

Table of Valid Goals

ENHANCED INFRARED HOCKEY PUCK AND GOAL DETECTION SYSTEM

TECHNICAL FIELD

The present disclosure relates to methods, techniques, and systems for goal detection systems. In particular, the present disclosure relates to a goal detection system including an infrared transmitting hockey puck and infrared sensing goal detection system configured to communicate with each other and other devices and provide automatic tracking and notification.

BACKGROUND

The sport of hockey is a fast-paced game played using hockey sticks and a single ball or puck, which is passed between players for the purpose of placing the ball or puck into a hockey goal. The speed of the players and the small size of the puck make it difficult for spectators and viewers to watch the game and recognize the location of the puck during gameplay. Visual cues from the players' movements are generally used to locate the puck, however when in proximity to the goal locating the puck becomes even more difficult. Moreover, determining when the puck has passed over the threshold of the goal can sometimes be difficult if there are several players around the goal.

When watching televised hockey games, locating the puck can be particularly difficult for viewers at home. Not only does this make it difficult to follow the game at times, but it can also lead to an overall decreased interest in the gameplay. Similarly, camera crews, referees, coaches, players, and goalies may also lose sight of the puck, particularly when in close proximity to the goal. This can be frustrating for all involved and is especially problematic for referees when calling scored goals. The current methods for determining when a goal is scored involves video replay. This technique can be hampered if the goalie or other players crowd the goal area and block the field of view of the camera within the goal. This makes determination of a scored goal impossible, particularly when many players are scrambling around the goal and the goalie is covering the puck.

DETAILED DESCRIPTION

Figure 1:
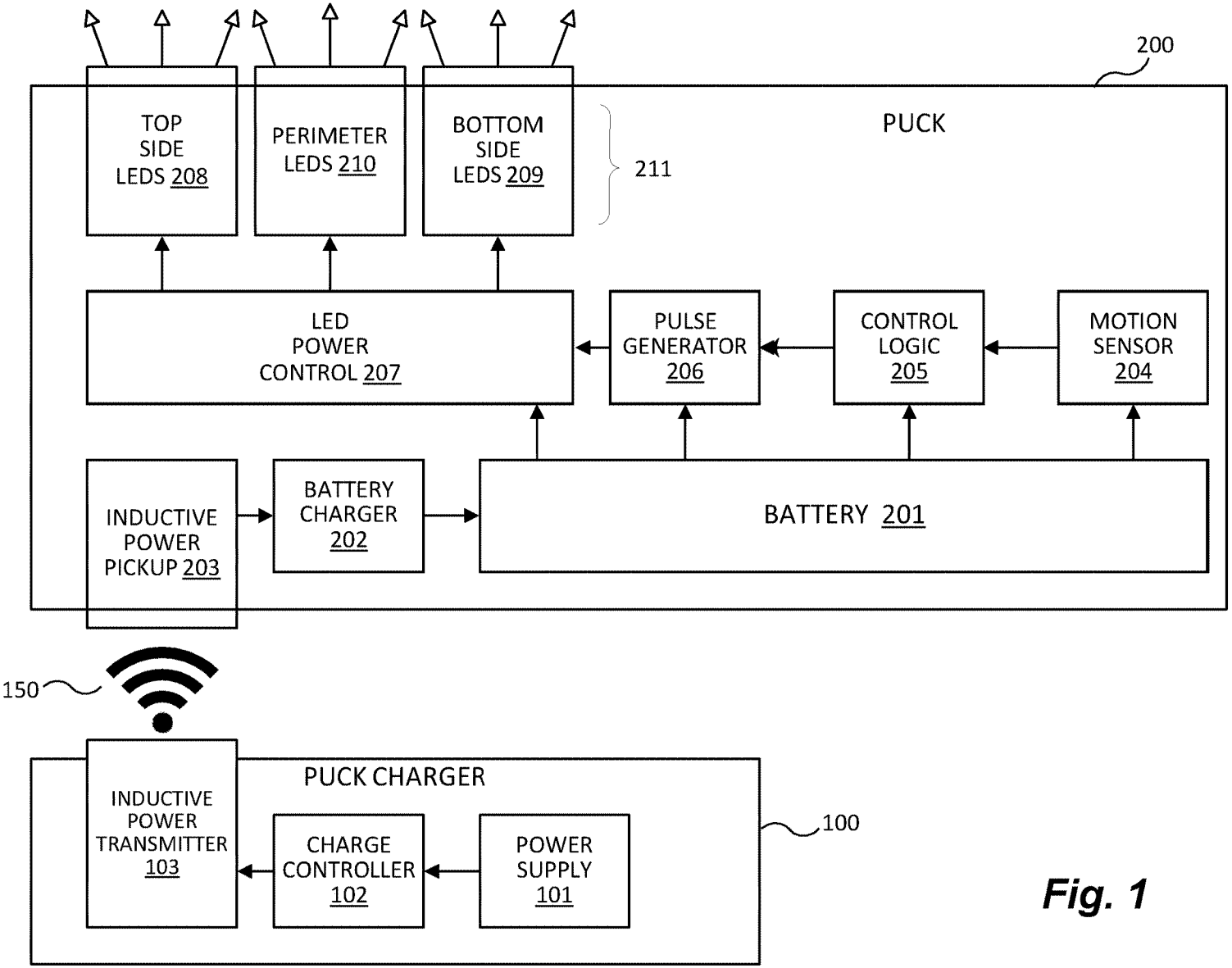
FIG. 1 is a block diagram of an example improved hockey puck configured to communicate with an improved goal frame and a charging device of an example Automated Hockey Goal Detection System.

Embodiments described here provide improvements for automatically detecting and tracking hockey goal events during hockey play. Example embodiments provide an Automated Hockey Goal Detection System ("AHGDS" or "goal detection system"), which enables goal events during hockey play to be automatically and immediately (in real-time or near real-time) detected and notifications generated therefor and for automatically tracking and communicating attributes of such events such as puck speed and location. Automatically generated notifications may take various forms and thus may be indicated by audio, visual, and/or haptic mechanisms (e.g., announced, flashed, and the like) to an integrated device and/or to a device remote from the goal detection system. Further, event information may be automatically recorded and/or communicated to other devices, such as a remote computing device, for use in analyzing player or game effectiveness during coaching or game activities. In addition, the automatically recorded event activity may be used to produce reports or to communicate wirelessly with players, coaches, evaluators, and/or other personnel while play is ongoing. This allows for immediate feedback and possible corrective action.

For example, for athlete training purposes or during game play, it may be valuable to know how many times the puck has entered the frame, where and when the puck has entered the goal frame, and at what speed. Further, athletes often practice shooting the puck at multiple locations within the goal frame and feedback regarding effectiveness may be desired. For example, during training a coach may issue commands to shoot the puck at a particular location in the goal frame (upper left, upper right, center, etc.). Since the speed at which this happens is so fast and difficult to observe with the naked eye, a goal detection system such as example AHGDSes described here, which can automatically determine the puck location and speed when the puck crosses the goal, can provide valuable and more accurate information. Moreover, the automated nature of example AHGDS goal detection provides unbiased information regarding goal events which leads to greater accuracy for coaching and reporting purposes.

Using an example AHGDS, upon the puck entering the goal frame, the AHGDS can determine its location and perform some action as a result. The action might entail communicating the determined information or causing some indication of the goal event. For example, the puck location can be indicated by lighting up a specific section of the goal frame or the puck location may be transmitted wirelessly to a remote computing device (phone, tablet, etc.) for other purposes, such as to inform training software as to the puck location and speed.

An example goal detection system for performing such functions utilizes an infrared transmitting hockey puck and an infrared sensing goal frame with multiple infrared sensors arranged around the perimeter of the goal frame. The goal frame may include a control unit that determines the location of the puck within the goal frame by evaluation of the active sensors. For example, improvements to an infrared transmitting hockey puck and an infrared sensing goal frame such as those described in U.S. Pat. No. 10,507,374, titled "INFRARED HOCKEY PUCK AND GOAL DETECTION SYSTEM, issued Dec. 17, 2019; U.S. Pat. No. 10,434,397, of the same title, issued Oct. 8, 2019; and in U.S. patent application Ser. No. 16/864,116 of the same title, filed Apr. 30, 2020, which disclosures are incorporated herein in their entireties, may be used to implement the improved goal detection systems described here.

In brief operation, in an example AHGDS, when the infrared transmitting hockey puck crosses the goal line of the infrared sensing goal frame, the goal frame determines the location of the puck within the goal frame by evaluation of active sensors. In another example AHGDS, the goal detection system may communicate with a remote computing device to transmit notification of the goal event and puck location and/or puck speed to the remote computing device. The remote computing device may be wirelessly connected or wired to the goal detection system and may be any such computing device capable of accepting event information such as a phone, tablet, desktop, or other stationary or mobile computing device.

In one example AHGDS, the infrared sensing goal frame comprises multiple sets of infrared sensors arranged around the perimeter of the goal frame. Each set of sensors is arranged in a plane and offset from other planes of sensors. By offsetting the sensor set planes, a control unit of the improved goal frame determines the puck velocity by measuring the difference in time between activation of each sensor plane. Other known systems measure puck speed differently, such as by detection of a puck obstructing infrared energy transmitted from one side of a goal frame to the other.

Although the AHGDS is described with respect to the sport of hockey and used with an improved hockey puck and improved goal frame, it is contemplated that the concepts described herein and similar techniques may be used for other purposes. For example, techniques for automatic speed and tracking detection of a moving object such as a puck passing within a constrained target space (such as defined by a hockey goal frame) may be employed in other types of sporting events and with other sporting equipment. Also, although the examples described herein refer to retrofitting or fitting a goal frame with sensors through assembly techniques such as those described in U.S. Pat. No. 10,507,374, it is contemplated that other forms of producing such a goal frame may also be used as part of an AHGDS in order to enhance a goal frame with automated sensing and a controller for same. For example, a goal frame may be constructed and manufactured with integrated LEDs and an integrated controller, or partially integrated, or the like. Similarly, other forms for communication such as using radio frequency transmitters and receivers outside of the range infrared frequencies may also be used with example AHGDSes and still accomplish the automated detection, tracking, and reporting of goals as described here.

Also, although certain terms are used primarily herein, other terms could be used interchangeably to yield equivalent embodiments and examples. In addition, terms may have alternate spellings which may or may not be explicitly mentioned, and all such variations of terms are intended to be included.

In the following description, numerous specific details are set forth, such as data formats and code sequences, etc., in order to provide a thorough understanding of the described techniques. The embodiments described also can be practiced without some of the specific details described herein, or with other specific details, such as changes with respect to the ordering of the logic, different logic, etc. Thus, the scope of the techniques and/or functions described are not limited by the particular order, selection, or decomposition of aspects described with reference to any particular routine, module, component, and the like.

As described above, an example Automated Hockey Goal Detection System utilizes an infrared transmitting hockey puck and an infrared sensing goal frame with multiple infrared sensors arranged around the perimeter of the goal frame such as those described in U.S. Pat. No. 10,507,374. In some instances, the hockey puck and/or the goal frame are configured to communicate with a remote computing device.

FIG. 1 is a block diagram of an example improved hockey puck configured to communicate with an improved goal frame and a charging device of an example Automated Hockey Goal Detection System. In FIG. 1, rechargeable puck 200, e.g., an infrared transmitting hockey puck, is configured to communicate via wireless signals 150 with a puck charger 100 and radiates pulsed infrared light.

Wireless puck charger 100 comprises a power supply 101, charge controller circuit 102 and inductive power transmitter 103. Power is converted from the supply into an electromagnetic field 150 to charge a battery 201 within the goal detection system's hockey puck 200

Hockey puck 200 radiates pulsed infrared light at a fixed frequency while in play. The puck 200 comprises a battery 201, battery charger 202, inductive power pickup 203 for wireless charging, motion sensor 204, control logic 205, pulse generator 206, LED power control circuit 207 and an array of LEDs (light emitting diodes) 211. The array of LEDs 211 are mounted on the top (LEDs 208), the bottom (LEDs 209) and about the perimeter (LEDs 210) of the puck as shown in FIG. 2.

When the puck motion sensor 204 senses motion that indicates play (e.g., acceleration exceeding 1G) the control logic 205 activates a pulse generator 206 that commands a LED power control circuit 207 to send energy pulses to the array of LEDs 211 including the topside mounted LEDs 208, bottom side mounted LEDS 209, and perimeter LEDs 210. When the control logic 205 does not receive motion indications from the motion sensor 204 for longer than 20 seconds, the control logic 205 ceases to command the LED power control circuit 207 to send pulses energy to LEDs—this conserves battery energy for when the puck 200 is actively in play.

When the puck 200 is in proximity to the puck charger 100, an electromagnetic field couples the inductive power transmitter 103 of the puck charger 100 to the inductive power pickup 203 of the puck 200, enabling charging to occur.

Figure 2:
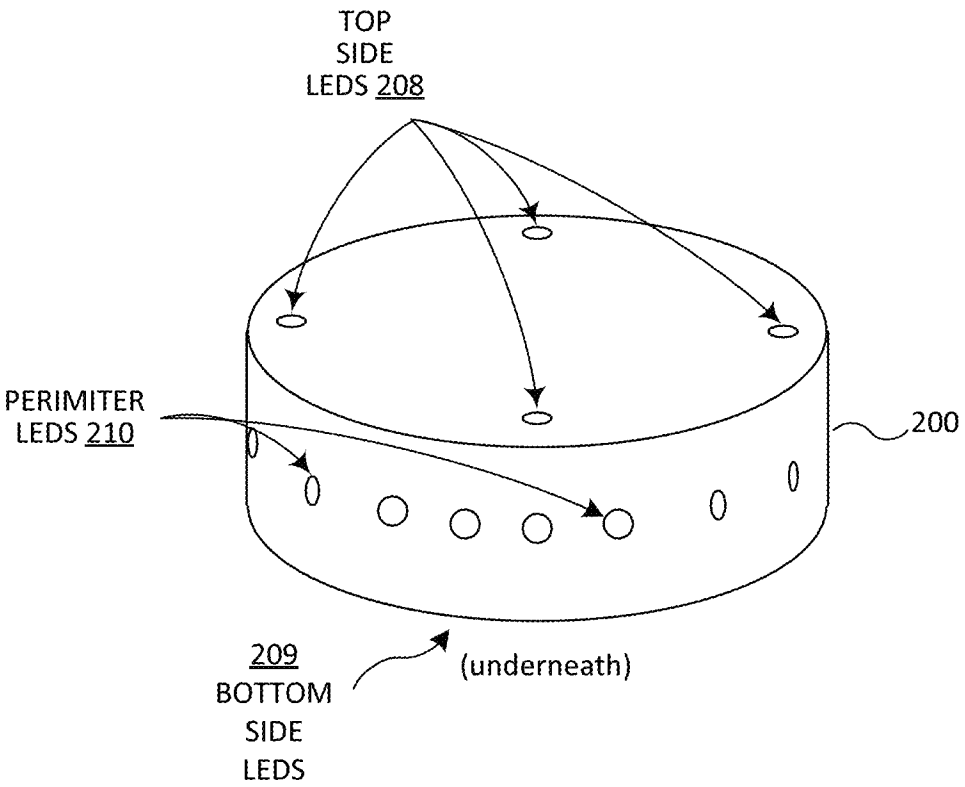
FIG. 2 is a perspective diagram illustrating further details of the improved hockey puck used with an example Automated Hockey Goal Detection System.

FIG. 2 is a perspective diagram illustrating further details of the improved hockey puck used with an example Automated Hockey Goal Detection System. In particular, the array of LEDs 211 is shown mounted on puck 200 and comprises perimeter LEDs 210, top side LEDs 208, and bottom side LEDs 209.

Figure 3:
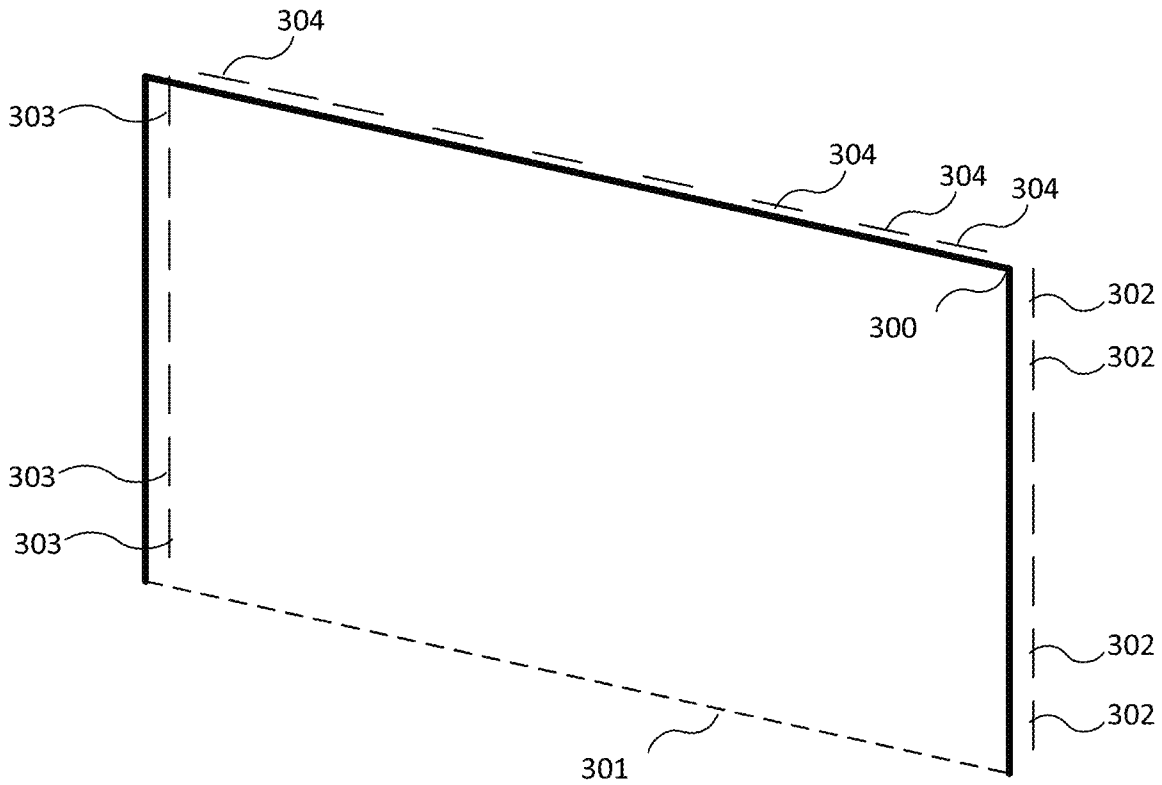
FIG. 3 is a block diagram of an improved goal frame that can be used with an example Automated Hockey Goal Detection System.

FIG. 3 is a block diagram of an improved goal frame that can be used with an example Automated Hockey Goal Detection System. The improved vertical goal frame 300 includes with multiple infrared receivers (signal detectors) located and spaced around the goal frame. These receivers may be strategically located to indicate information regarding goal events, may be distributed at fixed or variable intervals around the goal frame 300, or any other combination of placement. Vertical goal frame 300 is typically constructed of welded steel arranged with a (virtual) goal-line 301 (shown as dashed line 301) and is perpendicular to the horizontal playing surface (typically ice).

In one example AHGDS, infrared sensors 310 (see FIG. 4) are mounted behind the goal frame 300 on the left side as infrared sensors 303, on the top side as infrared sensors 304 and on right side as infrared sensors 302. These sensors are positioned behind the goal line 301 and are used to detect presence of the hockey puck 200 traversing the goal line.

Figure 4:
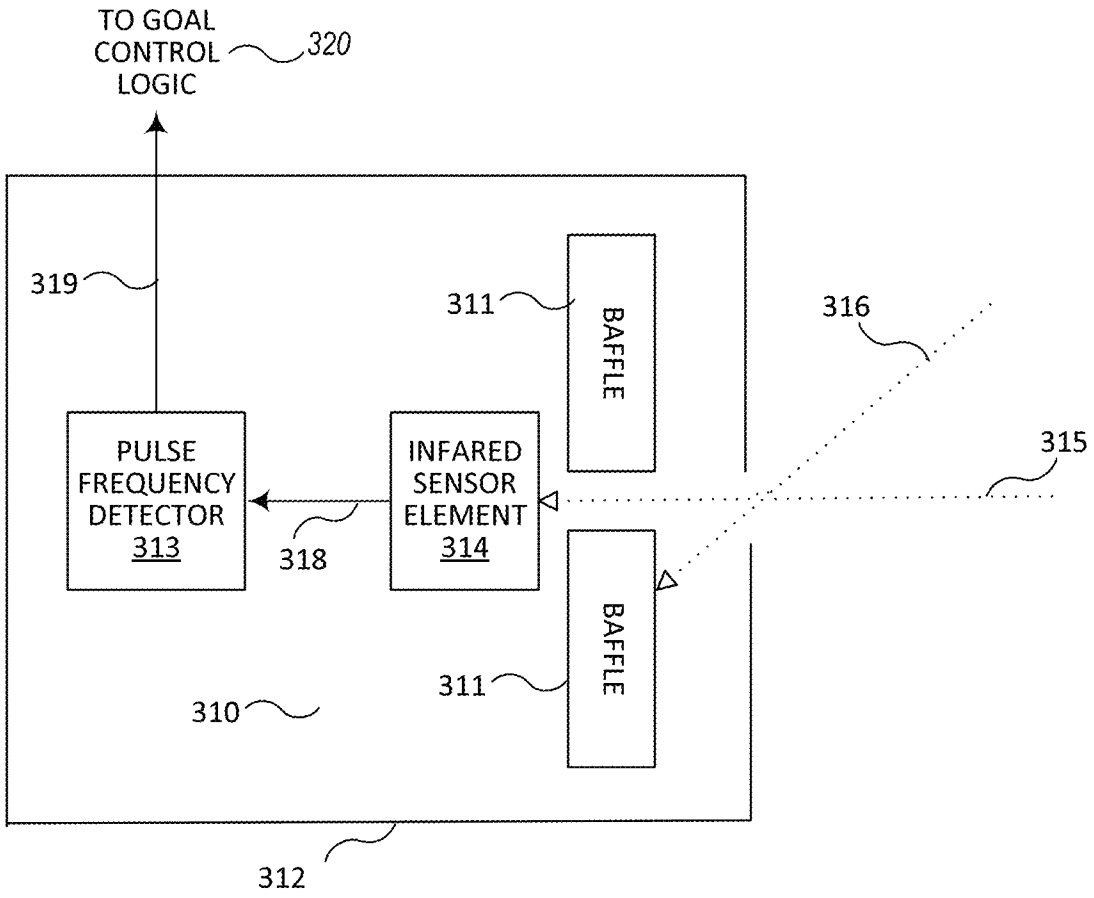
FIG. 4 is a block diagram of an example sensor of an improved goal frame of an example Automated Hockey Goal Detection System.

FIG. 4 is a block diagram of an example sensor of an improved goal frame of an example Automated Hockey Goal Detection System. Each infrared sensor 310 resides in an "opaque" (to infrared) housing 312. This housing may be individual for each sensor or shared among several sensors.

Each housing 312 for each sensor 310 comprises an infrared sensor element 314, one or more baffles 311, and a pulse frequency detector 313. Within the housing 312 are one or more baffles 311 that block rays of infrared energy that are not directly in line with the infrared sensor element 314. In the diagram, the infrared light 315 in line with the sensor 314 has an unobstructed path to the sensor 314 whereas infrared light 316 that is not in line with the sensor 314 absorbed by the baffles 311. Once the infrared sensor element 314 detects light, it converts infrared light energy (from path 315) into an electrically observable signal 318. When the infrared light is pulsed, the electrically observable signal 318 also pulses. The pulse frequency detector 313 processes the signal 318 from the infrared sensor element 314 and produces a digital signal 319 which is forwarded to the goal frame control logic (not shown) when the pulse frequency matches the frequency sent by the puck 200. For example, the goal frame control logic may be executed by a microcontroller unit affixed to or integrated with the improved goal frame, such as microcontroller unit 530 in U.S. Pat. No. 10,507,374.

Control logic 320 receives digital signals from the infrared sensors indicating that the puck 200 is at the goal line 301 (FIG. 3) in the vicinity of the signal producing infrared sensors, e.g. some portion of signals 302-304 of FIG. 3. This control logic 320 observes the signals received from the sensors and determines whether the pattern and timing of the activated sensors (the sensors have forwarded signals to the control logic 320) represent a valid goal. In this same manner, the location of the puck in the goal frame 300 may also be determined.

More specifically, the determination of whether a valid goal has transpired and the location of the puck, involves evaluating the duration(s) of active sensor signals of the activated sensors. If an activated sensor produces a signal for less time than the signal generated by a "fastest reasonable" puck, then the control logic 320 classifies this signal as spurious and not indicative of a valid goal. Alternatively, if the signal lasts equal to or longer than the fastest reasonable puck, the control logic 320 classifies this signal as a valid goal.

For example, if the active area of the sensor (detector) is about ¼ inch wide and a puck's speed can be as high as 105 miles per hour, then the duration of the active sensor signal should be at least 135.3 microseconds if it is to be considered a valid goal. (The computation changes for the active area of the sensor and the maximum puck speed.) Anything less than this duration is considered spurious.

This determination also involves evaluating the locations of the activated receivers to determine that the activation represents a valid goal and not noise. In at least one example AHGDS, the control logic 320 hosts or accesses a lookup table of valid sensor combinations. The lookup table contains all valid sensor combinations and the puck location indicated by the combination of sensors. Sensor combinations that are not producible by a single puck entering the goal frame 300 do not exist in the valid goal lookup table. For example, if the puck is seen simultaneously in opposite corners of the goal, and nowhere in between, this would not exist in the lookup table. For example, it is not likely that a sensor on each of the two opposite vertical posts (sensors 302 and 303) can both be activated for a valid goal. Equivalents to the lookup table (such as a hash table, file, array, etc.) may also be incorporated.

Figure 5:
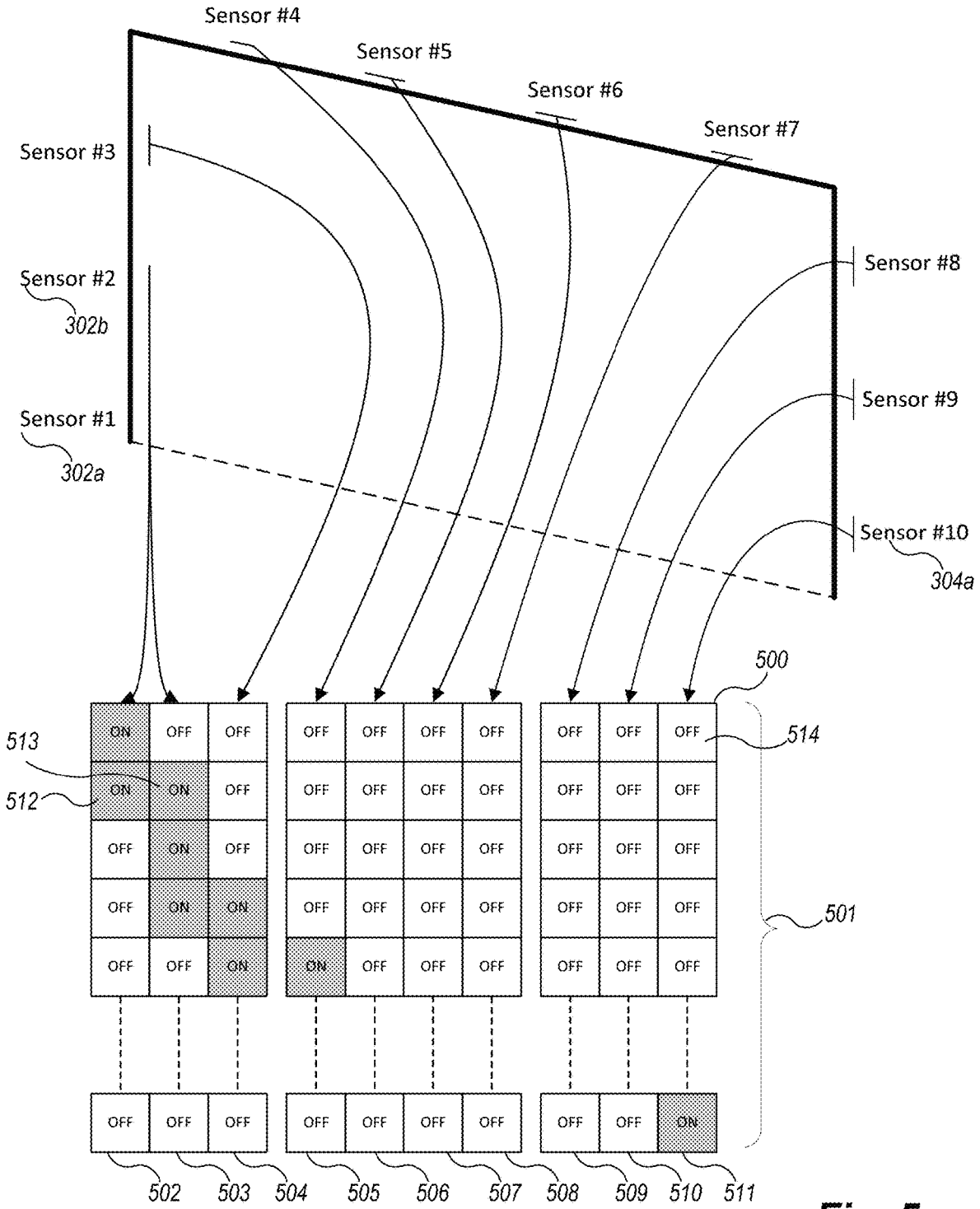
FIG. 5 is a block diagram of an example table used to detect valid goals from sensors of an improved goal frame of an example Automated Hockey Goal Detection System.

FIG. 5 is a block diagram of an example table used to detect valid goals from sensors of an improved goal frame of an example Automated Hockey Goal Detection System. Upon receiving signals from the sensors 302-304, the control logic 320 searches the lookup table 500 for the pattern of active sensors. If the pattern of active sensors pexists in the lookup table 500, control logic 320 determines the goal is valid and the location of the puck 200 within the improved goal frame 300. The precision of the location determination depends upon the number and placement of the sensors.

For example, in FIG. 5, lookup table 500 is shown comprised of a series of rows of patterns 501 and a single column 502-511 for each sensor (e.g., sensors 302-304) that can detect (receive) signals from the improved hockey puck, such as puck 200. Each cell, for example cell 512, which corresponds to sensor #1 (302*a*) and cell 513, which corresponds to sensor #2 (302*b*), are indicated as "ON" to signify a location that is between sensor #1 and sensor #2. When this occurs, cell 514, which corresponds to sensor #10 (304*a*) on the opposite side of goal frame 300 is properly indicated as "OFF." In other example AHGDS implementations, there may be a different level of granularity for detecting valid location patterns of a puck 200, such as by including more or less sensors.

Figure 6:
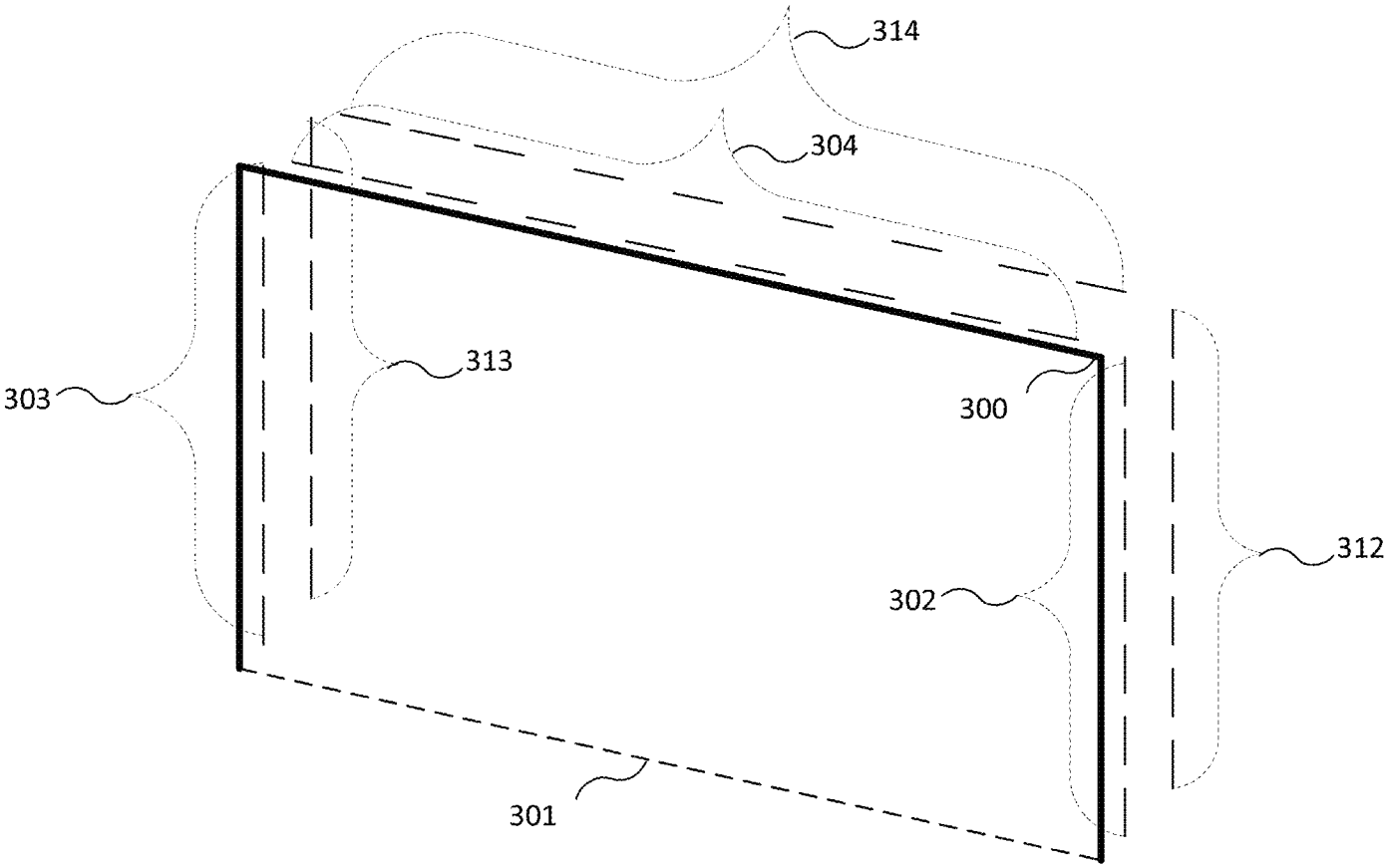
FIG. 6 is a block diagram of another example improved goal frame with an additional set of sensors usable with an example Automated Hockey Goal Detection System.

FIG. 6 is a block diagram of another example improved goal frame with an additional set of sensors usable with an example Automated Hockey Goal Detection System. Using the scenario depicted by FIG. 6, it is possible to determine the speed of the puck 200 at the moment it passes the goal line 301. This speed can be determined by itself or in conjunction with determination of the location of a goal using the techniques described with reference to FIG. 5.

More specifically, improved goal frame 300 is shown in FIG. 6 with two separated sets of infrared sensors distributed around the perimeter of the goal frame 300. These two sets of infrared sensors are positioned one set behind the other. For example, the second set of infrared sensors 312-314 may be positioned behind the first set of infrared sensors 302-304 respectively, a known distance apart. Recall that the first set of infrared sensors 302-304 are mounted typically right behind the goal line 301. In some implementations sensors 302-304 may be mounted in line with the goal line 301. First, control logic 320 receives digital signals from the infrared sensors indicating the puck 200 is in the plane of the first set of sensors 302, 303, and 304. Sometime later, control logic 320 receives signals indicating the puck 200 is in the plane of the second set of sensors 312, 313, and 314. The control logic 320 can then determine puck speed by noting the time difference between activation of the first and second set of sensors at the triggered (activated) locations. Puck velocity is typically determined as (distance between first and second sensor set)/(time between activation of first and second sensor set).

As previously mentioned, the goal detection system may communicate with a remote computing device to transmit (forward, send, notify, etc.) notification of a goal event and puck location and/or puck speed. This notification may be used, for example, for player or game effectiveness analysis during coaching or game activities. In addition, an automatically recorded event activity (which may optionally include goal event location and puck speed) may be used to produce reports or to communicate wirelessly with players, coaches, evaluators, and/or other personnel while play is ongoing.

Figure 7:
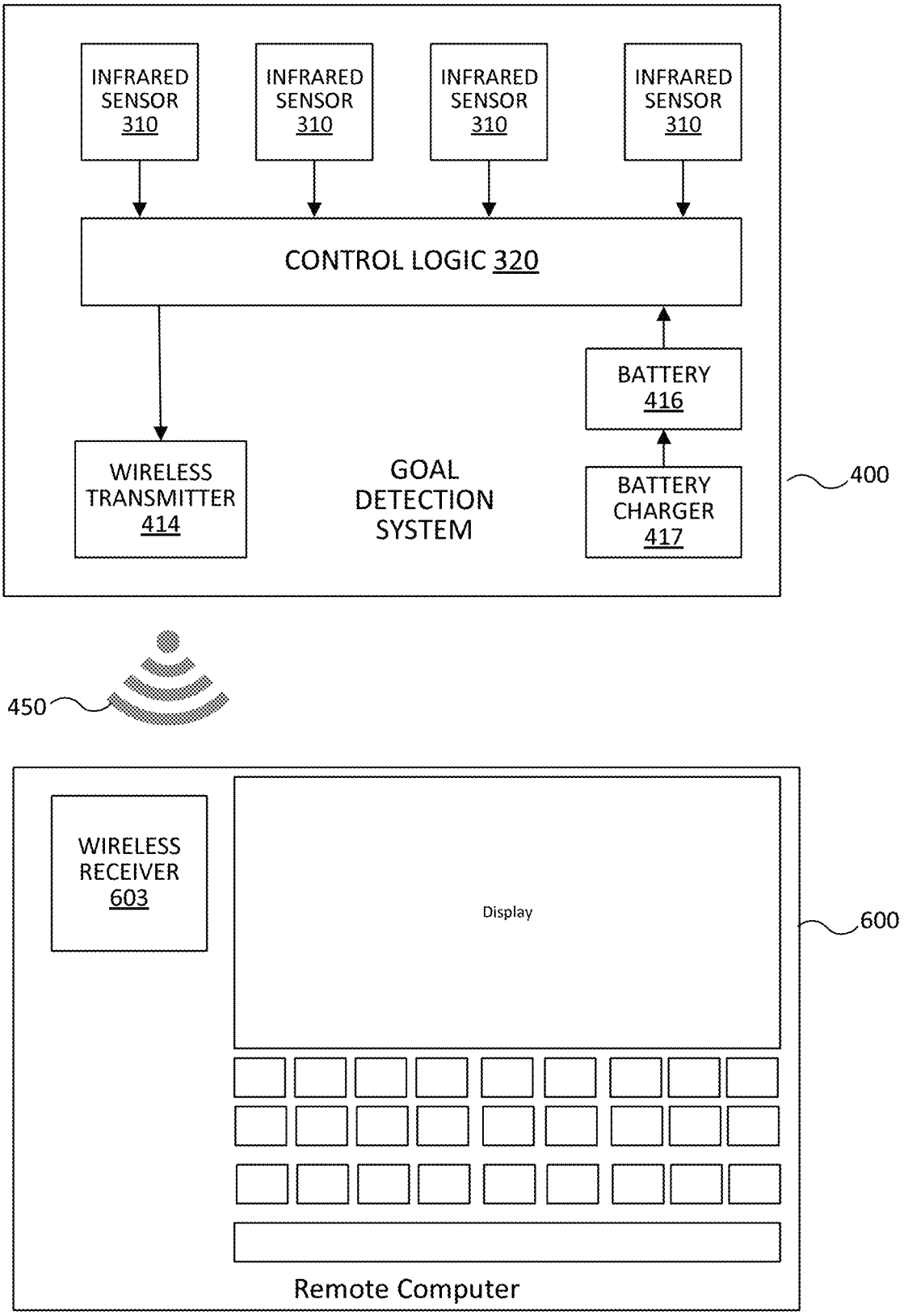
FIG. 7 is a block diagram of an example Automated Hockey Goal Detection System in communication with a remote computing device.

FIG. 7 is a block diagram of an example Automated Hockey Goal Detection System in communication with a remote computing device. In FIG. 7, the example goal detection system (AHGDS) 400 comprises the one or more sensors 310, control logic 320, a battery 416, a battery charger 417, and a wireless transmitter 414. In some implementations, the battery charger 417 and battery 416 may be separate from the other components. Also, in some implementations, the components may be housed together in a single housing and attached to the improved goal frame 300. The wireless transmitter 414 communicates via wireless signals 450 to the remote computing device 600 and may be radio (e.g., WiFi, Bluetooth) or optical (e.g., IRDA) in nature. An example remote computing device 600 may comprise a remote computer having a keyboard and display and a wireless receiver 603 (or transceiver). Other remote computing devices may comprise additional or different components. The remote computing device 600 may be for example, a coach's or officiant's phone, tablet or some other remote data collection or reporting computer. The control logic 320 may be supplied by a microcontroller (not shown) integrated into or affixed to the improved goal frame 300 as described above.

In operation, upon determining that the puck 200 has crossed the goal line 301, the control logic 320 (e.g., in the microcontroller not shown) activates a wireless transmitter 414 when it detects a goal event as described above. The wireless transmitter 414 sends wireless energy 450 to a remote computing device 600, which then processes the received information. For example, an application running on the remote computing device 600 may process received information by actions such as to report goal event information, track goal event and/or player statistics or information, produce reports, communicate with other devices (such as a remote annunciator device), and the like.

Figure 8:
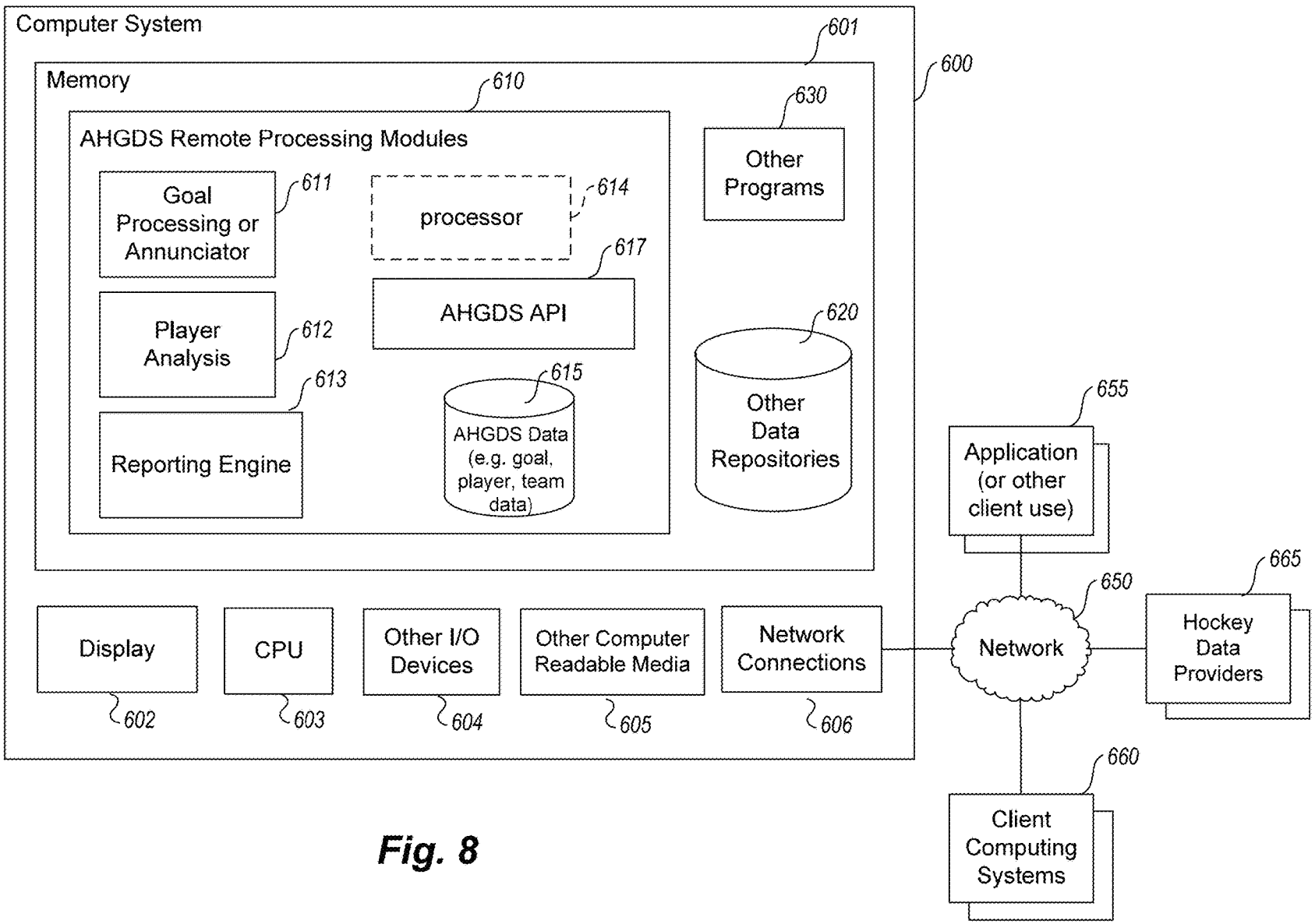
FIG. 8 is an example block diagram of a computing system for practicing communication of a remote computer with an example Automated Hockey Goal Detection System.

FIG. 8 is an example block diagram of a computing system for practicing communication of a remote computer with an example Automated Hockey Goal Detection System. In FIG. 8, any number or variety of remote processing modules 610 may be processing information received from the goal detection system 400, for example, via wireless receiver 603.

Note that one or more general purpose virtual or physical computing systems suitably instructed or a special purpose computing system may be used to implement a remote computer for use with AHGDS. However, just because it is possible to implement the remote computing system on a general purpose computing system does not mean that the techniques themselves or the operations required to implement the techniques are conventional or well known. Further, the remote computing system may be implemented in software, hardware, firmware, or in some combination to achieve the capabilities described herein.

The computing system 600 may comprise one or more server and/or client computing systems and may span distributed locations. In addition, each block shown may represent one or more such blocks as appropriate to a specific embodiment or may be combined with other blocks. Moreover, the various blocks of the AHGDS remote processing modules 610 may physically reside on one or more machines, which use standard (e.g., TCP/IP) or proprietary interprocess communication mechanisms to communicate with each other.

In the embodiment shown, computer system 600 comprises a computer memory ("memory") 601, a display 602, one or more Central Processing Units ("CPU") 603, Input/Output devices 604 (e.g., keyboard, mouse, CRT or LCD display, etc.), other computer-readable media 605, and one or more network connections 606. The AHGDS remote processing modules 610 are shown residing in memory 601. In other embodiments, some portion of the contents, some of, or all of the components of the AHGDS remote processing modules 610 may be stored on and/or transmitted over the other computer-readable media 605. The components of the AHGDS remote processing modules 610 preferably execute on one or more CPUs 603 and manage the processing, tracking, comparison, and other reporting of goal event data, as described herein. Other code or programs 630 and potentially other data repositories, such as data repository 620, also reside in the memory 601, and preferably execute on one or more CPUs 603. Of note, one or more of the components in FIG. 6 may not be present in any specific implementation. For example, some embodiments embedded in other software may not provide means for user input or display.

In a typical embodiment, the AHGDS remote processing modules 610 includes one or more goal processing or annunciators 611, one or more player analysis modules 612, and one or more reporting engines 613. In at least some embodiments, the reporting engines 613 is provided external to the AHGDS and is available, potentially, over one or more networks 650.

In an example AHGDS, the goal processing or annunciators 611 may provide additional mechanisms for automatically announcing detected goals such as by auditory, haptic, and/or visual means. The player analysis modules 612 may provide indicators of puck location and speed for each goal event and/or may provide comparison information with other players or other teams. Reporting engines 613 may provide statistical reports or other types of visual reports. In addition, other processing such as applications that compare statistics or trends of players (for example, relative to known professional players) may be provided.

Other and/or different modules may be implemented. In addition, the AHGDS remote processing modules 610 may interact via a network 650 with application or client code 655 that e.g. uses results computed by the AHGDS remote processing modules 610, one or more client computing systems 660, and/or one or more third-party information provider systems 665, such as purveyors of hockey data used in AHGDS data repository 615. In addition, application or client code 655 may communicate with the AHGDS Remote Processing Modules via an AHGDS API (application programming interface) 617. Also, of note, the AHGDS data repository 615 may be provided external to the AHGDS as well, for example in a knowledge base accessible over one or more networks 650.

In an example embodiment, components/modules of the AHGDS remote processing modules 610 are implemented using standard programming techniques. For example, the AHGDS remote processing modules 610 may be implemented as a "native" executable running on the CPU 603, along with one or more static or dynamic libraries. In other embodiments, the AHGDS remote processing modules 610 may be implemented as instructions processed by a virtual machine. In general, a range of programming languages known in the art may be employed for implementing such example embodiments, including representative implementations of various programming language paradigms, including but not limited to, object-oriented, functional, procedural, scripting, and declarative.

The embodiments described above may also use well-known or proprietary, synchronous or asynchronous client-server computing techniques. Also, the various components may be implemented using more monolithic programming techniques, for example, as an executable running on a single CPU computer system, or alternatively decomposed using a variety of structuring techniques known in the art, including but not limited to, multiprogramming, multi-threading, client-server, or peer-to-peer, running on one or more computer systems each having one or more CPUs. Some embodiments may execute concurrently and asynchronously and communicate using message passing techniques. Equivalent synchronous embodiments are also supported. Also, other functions could be implemented and/or performed by each component/module, and in different orders, and in different components/modules, yet still achieve the described functions.

In addition, programming interfaces to the data stored as part of the AHGDS remote processing modules 610 (e.g., in the data repositories 615) can be available by standard mechanisms such as through C, C++, C#, and Java APIs (e.g., AHGDS API 617); libraries for accessing files, databases, or other data repositories; through scripting languages such as XML; or through Web servers, FTP servers, or other types of servers providing access to stored data. The AHGDS data repository 615, which stores goal, player, team, and/or other hockey data may be implemented as one or more database systems, file systems, or any other technique for storing such information, or any combination of the above, including implementations using distributed computing techniques.

Also the example AHGDS remote processing modules 610 may be implemented in a distributed environment comprising multiple, even heterogeneous, computer systems and networks. Different configurations and locations of programs and data are contemplated for use with techniques of described herein. In addition, the server and/or client may be physical or virtual computing systems and may reside on the same physical system. Also, one or more of the modules may themselves be distributed, pooled or otherwise grouped, such as for load balancing, reliability or security reasons. A variety of distributed computing techniques are appropriate for implementing the components of the illustrated embodiments in a distributed manner including but not limited to TCP/IP sockets, RPC, RMI, HTTP, Web Services (XML-RPC, JAX-RPC, SOAP, etc.) and the like. Other variations are possible. Also, other functionality could be provided by each component/module, or existing functionality could be distributed amongst the components/modules in different ways, yet still achieve the functions of an AHGDS remote processing modules.

Furthermore, in some embodiments, some or all of the components of the AHGDS remote processing modules 610 may be implemented or provided in other manners, such as at least partially in firmware and/or hardware, including, but not limited to one or more application-specific integrated circuits (ASICs), standard integrated circuits, controllers executing appropriate instructions, and including microcontrollers and/or embedded controllers, field-programmable gate arrays (FPGAs), complex programmable logic devices (CPLDs), and the like. Some or all of the system components and/or data structures may also be stored as contents (e.g., as executable or other machine-readable software instructions or structured data) on a computer-readable medium (e.g., a hard disk; memory; network; other computer-readable medium; or other portable media article to be read by an appropriate drive or via an appropriate connection, such as a DVD or flash memory device) to enable the computer-readable medium to execute or otherwise use or provide the contents to perform at least some of the described techniques. Some or all of the components and/or data structures may be stored on tangible, non-transitory storage mediums. Some or all of the system components and data structures may also be stored as data signals (e.g., by being encoded as part of a carrier wave or included as part of an analog or digital propagated signal) on a variety of computer-readable transmission mediums, which are then transmitted, including across wireless-based and wired/cable-based mediums, and may take a variety of forms (e.g., as part of a single or multiplexed analog signal, or as multiple discrete digital packets or frames). Such computer program products may also take other forms in other embodiments. Accordingly, embodiments of this disclosure may be practiced with other computer system configurations.

From the foregoing it will be appreciated that, although specific embodiments have been described herein for purposes of illustration, various modifications may be made without deviating from the spirit and scope of the invention. For example, the methods, techniques, and systems for performing automated goal discussed herein are applicable to other architectures. Also, the methods and systems discussed herein are applicable to differing protocols, communication media (optical, wireless, cable, etc.) and devices (such as wireless handsets, electronic organizers, personal digital assistants, portable email machines, game machines, pagers, navigation devices such as GPS receivers, etc.).

The invention claimed is:

1. An automated goal detection system, comprising:

goal detection control logic;

a first set of infrared sensors operatively connected to the goal detection control logic and attached to a vertical goal frame, the infrared sensors being located around a perimeter of the goal frame, and without any infrared sensors being located parallel to a crossbar along a surface upon which the goal frame rests, and each of the infrared sensors having a unique identifiable location, wherein the first set of infrared sensors are configured to form a sensing zone across a goal line, and wherein each one of the infrared sensors is configured to automatically detect an infrared signal emitted from an infrared transmitter of a puck when the emitted signal from the puck is within unobstructed detection of the one sensor and configured to send a corresponding digital signal to the goal detection control logic;

wherein the each one of the infrared sensors is operatively connected to the goal detection control logic using a pulse frequency detector located in the infrared sensor that transmits the corresponding digital signal to the goal detection control logic in response to detecting infrared light energy from the puck and wherein each one of the infrared sensors further comprises one or more baffles to block an infrared signal emitted from the infrared transmitter of the puck when the signal emitted from the puck is not in line with a corresponding infrared sensor element of the infrared sensor;

wherein the vertical goal frame is a hockey goal frame and the puck is a hockey puck; and wherein the goal detection control logic is further configured to automatically receive one or more corresponding digital signals from one or more of the infrared sensors, automatically determine whether the corresponding signals constitute a valid goal event, and automatically determine a corresponding location of the goal event relative to the goal frame based upon the unique identifiable locations of the one or more sensors from which the corresponding digital signals were received.

2. The system of claim 1 wherein the goal detection control logic is further configured to automatically communicate the valid goal event and the corresponding location to a remote computing system.

3. The system of claim 2 wherein the goal detection control logic is further configured to communicate a plurality of statistics relating to the valid goal event and/or the corresponding location to the remote computing system.

4. The system of claim 2, further comprising wherein the goal detection control logic is configured to communicate with the remote computing system through wireless communication.

5. The system of claim 1 wherein the corresponding location of the goal event relative to the goal frame is automatically determined based upon the location of each of the sensors around the perimeter of the goal frame from which a corresponding digital signal was received.

6. The system of claim 1 wherein each of the infrared sensors is configured to automatically detect an infrared signal emitted from an infrared transmitter of a puck when the emitted signal is in line with the infrared sensor element of the infrared sensor and to cause the pulse frequency detector located in the sensor to transmit the corresponding digital signal to the goal detection control logic upon detection of the infrared signal.

7. The system of claim 1 wherein the goal detection control logic is further configured to automatically determine whether the corresponding signals constitute a valid goal event by performing a look up to determine whether the identifiable location of each of the one or more sensors from which the corresponding signals were received form a pattern that represents a valid goal.

8. The system of claim 1 wherein the goal detection control logic is further configured to automatically determine whether the corresponding signals constitute a valid goal event by evaluating the duration of a received corresponding signal in comparison to puck speed.

9. The system of claim 1, further comprising:

a second set of infrared sensors operatively connected to the goal detection control logic and attached to a vertical goal frame behind the first set of infrared sensors and further away from the goal sensing zone such that a puck crosses the first set of infrared sensors before the second set of sensors when a goal event occurs, and wherein each of the infrared sensors of the second set are configured to automatically detect an infrared signal emitted from an infrared transmitter of a puck when the puck is within unobstructed detection of the sensor and configured to send a corresponding signal to the goal detection control logic.

10. The system of claim 9 wherein the goal detection control logic is further configured to automatically determine a corresponding speed of the puck when the logic determines that the corresponding signals constitute a valid goal event by comparing a difference in time between signals received from one or more of the first set of infrared sensors and signals received from one or more of the second set of infrared sensors.

11. A computer implemented method for automatically detecting a goal scored across a goal sensing zone of a hockey goal frame, comprising:

using a first set of sensors mounted around a perimeter of the goal frame and each having a unique identification associated with a corresponding location of the sensor on the goal frame, detecting a signal emitted from a transmitter of a hockey puck when the emitted signal from the puck is within unobscured detectability by one or more sensors of the first set of sensors; and for each detected signal, forwarding a corresponding digital signal to goal detection logic; and under control of the goal detection logic, receiving one or more digital signals from the one or more sensors positioned around the perimeter of the goal frame;

automatically determining whether the received digital signals constitute a valid goal event; and upon determining that a valid goal event has occurred, automatically associating the valid goal event with a location within the goal sensing zone based upon the unique identification of each of the one or more sensors from which the one or more digital signals are received;

wherein each sensor mounted on the perimeter of the goal frame comprises a sensor element, a pulse frequency detector, and one or more baffles configured to block a signal emitted from the transmitter of the hockey puck when the signal emitted from the hockey puck is not in line with the sensor element; and wherein each sensor mounted on the perimeter of the goal frame detects the signal emitted from the transmitter of a hockey puck when the emitted signal is in line with the sensor element and causes the pulse frequency detector of the sensor to transmit a digital signal to the goal detection logic to facilitate identification of location within the goal sensing zone of a goal event.

12. The method of claim 11, further comprising:

under control of the goal detection logic, upon determining that a valid goal event has occurred, automatically forwarding notification of event and associated location to a remote computing system.

13. The method of claim 11 wherein the automatically associating the valid goal event with a location within the goal sensing zone is determined based upon the location of each of the one or more sensors from which the one or more digital signals are received.

14. The method of claim 11, further comprising:

under control of the goal detection logic, automatically determining whether the received digital signals constitute a valid goal event by performing a look up to determine whether the unique identification of each of the one or more sensors from which the one or more digital signals are received form a pattern associated with a valid goal.

15. The method of claim 11, further comprising:

under control of the goal detection logic, automatically determining whether the received digital signals constitute a valid goal event by evaluating the duration of a received signal from the one or more sensors in comparison to puck speed.

16. The method of claim 11, further comprising:

using a second set of sensors mounted behind the first set of sensors and further away from the goal sensing zone such that a puck crosses the first set of sensors before the second set of sensors when a goal event occurs and each having a unique identification, detecting a signal emitted from a transmitter of a puck when the emitted signal from the puck is within unobscured detectability by one or more sensors of the second set of sensors; and for each detected signal, forwarding a corresponding digital signal to goal detection logic; and under control of the goal detection logic, receiving one or more digital signals from the one or more sensors of the second set of sensors; and upon determining that a valid goal event has occurred, automatically determining a corresponding speed of the puck by comparing a difference in time between signals received from one or more of the first set of sensors and signals received from one or more of the second set of sensors.

17. The method of claim 11 performed by a goal detection system that is configured to receive infrared signals from a hockey puck.

18. The method of claim 11 wherein digital signals are received from more than one of the sensors mounted around the perimeter of the goal frame and the goal detection logic determines whether corresponding locations of the more than one of the sensors from which the received digital signals are received form a pattern associated with a valid goal.

* * * * *